United States Patent [19]

Crawford et al.

[11] 4,380,418

[45] Apr. 19, 1983

[54] VACUUM PRESSURE SELECTION AND GENERATION DEVICE

[75] Inventors: Daniel A. Crawford, Fenton; Wayne A. Levijoki, Clio, both of Mich.

[73] Assignee: General Motors Corporation, Detroit, Mich.

[21] Appl. No.: 238,141

[22] Filed: Feb. 25, 1981

[51] Int. Cl.[3] ..... F04F 5/54

[52] U.S. Cl. ..... 417/87; 60/397; 123/389; 180/177; 417/151; 417/185

[58] Field of Search ..... 417/87, 151, 162, 182, 417/185, 192; 123/378, 389; 60/397, 421; 180/176, 177

[56] References Cited

U.S. PATENT DOCUMENTS

| | | | |
|---|---|---|---|
| 1,820,884 | 8/1931 | Hueber et al. | 417/189 X |
| 4,134,470 | 1/1979 | Riddel | 417/190 |
| 4,220,218 | 9/1980 | Riddel | 180/176 |
| 4,328,669 | 5/1982 | Mort | 60/397 |

*Primary Examiner*—Edward K. Look
*Attorney, Agent, or Firm*—D. D. McGraw

[57] ABSTRACT

An aspirator using positive pressure from a suitable source generates a vacuum pressure when the primary source of vacuum pressure, typically the engine intake manifold, prodcuces insufficient vacuum pressure to operate a device such as a road speed control servomotor. The aspirator assembly is connected to the source of positive pressure and the engine intake manifold as well as to atmosphere and to the device to be operated by vacuum power. When there is sufficient intake manifold vacuum pressure for the desired purpose, there is no flow through the aspirator and the engine intake manifold supplies all of the vacuum needs of the servomotor. When aspirator vacuum pressure is required due to insufficient manifold vacuum pressure, the aspirator is opened to generate aspirated vacuum pressure and the connection between the servomotor and manifold vacuum is closed. The aspirated air is delivered to the engine intake manifold.

3 Claims, 2 Drawing Figures

VACUUM PRESSURE SELECTION AND GENERATION DEVICE

The invention relates to an aspirator assembly and more particularly to one capable of generating aspirated vacuum pressure when required, and to select either engine manifold vacuum or aspirated vacuum as the source of vacuum power for a servomotor such as that used in vehicle road speed control systems.

IN THE DRAWING

Figure 1:
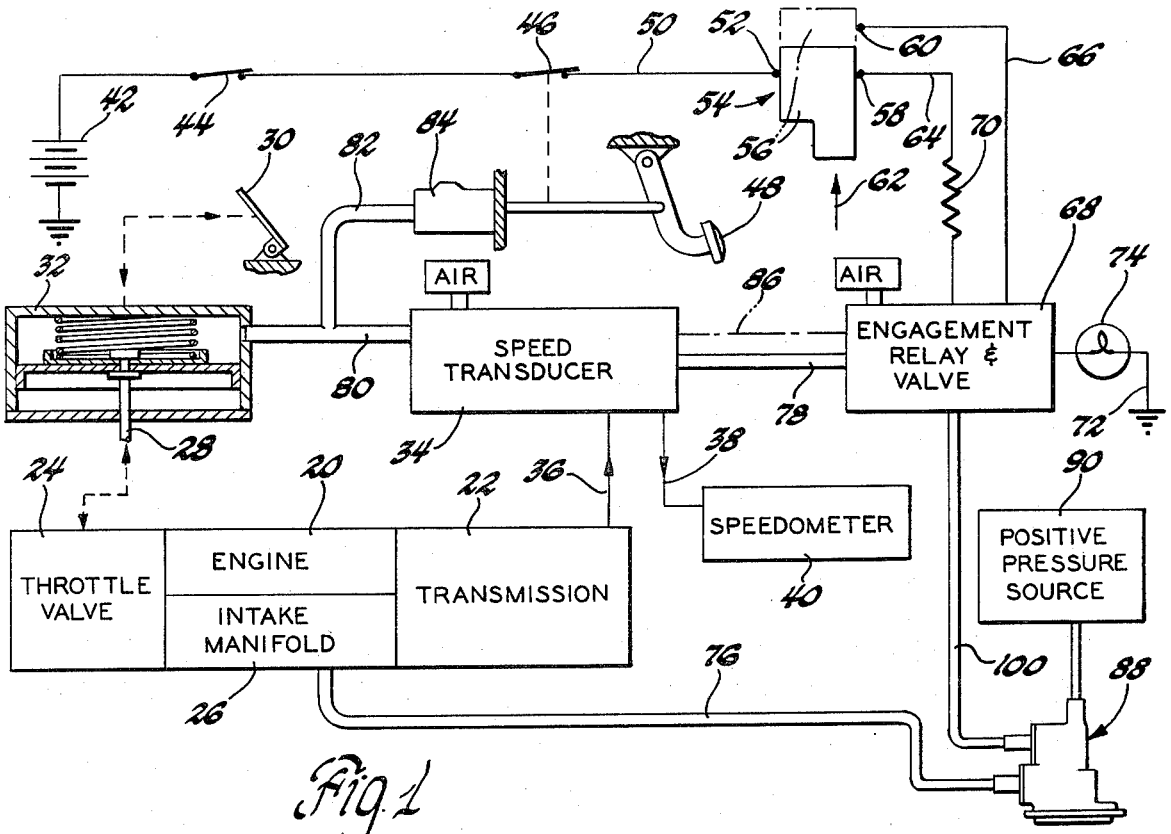
FIG. 1 is a schematic representation of a vehicle road speed control system utilizing a device embodying the invention, and having parts broken away and in section.

The system of FIG. 1 is based on the system disclosed in U.S. Pat. No. 3,441,104, entitled, "Vehicle Speed Transducer", issued Apr. 29, 1969; and U.S. Pat. No. 4,134,470, entitled, "Cruise Control System Using Positive Pressure To Boost Vacuum", issued Jan. 16, 1979. The system is shown installed in a motor vehicle having an engine 20 driving a vehicle transmission 22 and having a throttle valve 24, an engine intake manifold 26, and throttle linkage 28 connected to the throttle valve and manually actuated by the accelerator pedal 30. The system includes a power servomotor 32 which is connected to the throttle linkage 28. As schematically illustrated, the power servomotor 32 is actually a part of the throttle linkage 28 interconnecting the accelerator pedal 30 with the throttle valve 24. A speed transducer assembly 34 receives an actual vehicle speed signal through the transmission output shaft driven flexible cable 36 and compares it to a desired vehicle speed to generate a speed error signal to control the servomotor 32. An extension 38 of the flexible cable 36 drives the usual vehicle speedometer 40.

Portions of the system are electrical and include the source of electrical energy schematically illustrated as the vehicle battery 42, the ignition switch 44 and a normally closed switch 46, which is opened when the vehicle brakes are applied by depression of the brake pedal 48. These electrical elements are in series in electrical lead 50, which connects the brake switch 46 to a contact 52 of a manually controlled switch 54. The slide bar 56 of switch 54 is biased so that it is normally in electrical contact with switch contact 52 and another switch contact 58. A third switch contact 60 is so positioned that movement of the slide bar 56 in the direction of the arrow 62 will cause all three contacts 52, 58 and 60 to be in electrical contact with the slide bar 56. This position of the slide bar is illustrated in dashed lines. Further movement of the slide bar 56 in the direction of arrow 62 will electrically disconnect contact 52 from the slide bar. Electrical leads 64 and 66 are respectively connected to contacts 58 and 60 and lead to the engagement relay and valve assembly 68. Lead 64 contains a suitable resistor 70. Lead 72 from the engagement relay 68 may be suitably connected to electrical ground through a signal lamp 74.

Figure 2:
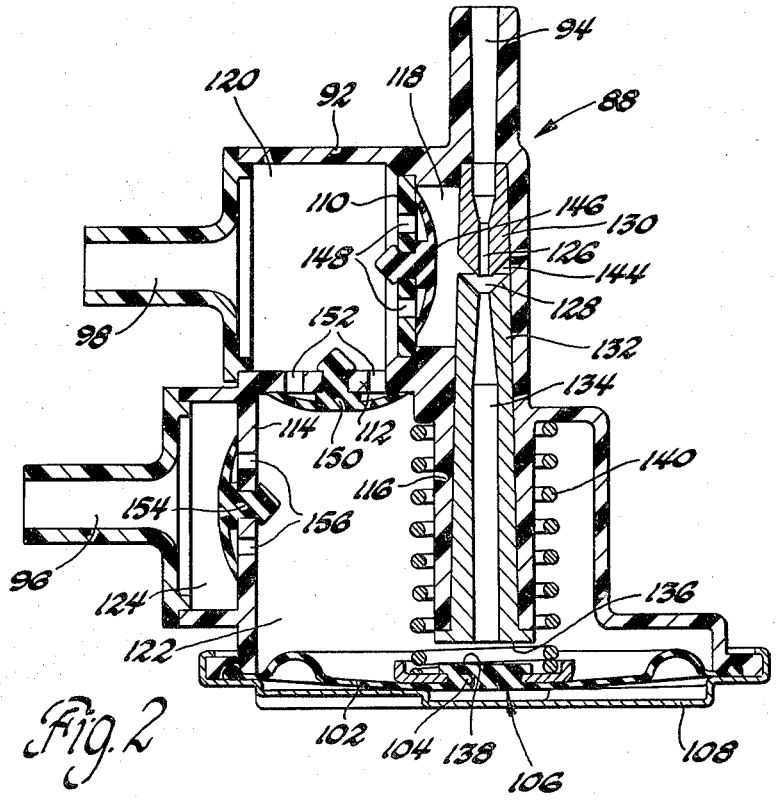
FIG. 2 is a cross section view of a device embodying the invention and shown in the system of FIG. 1.

The fluid circuit includes a conduit 76 fluid connecting the engine intake manifold 26 to the engagement relay and valve assembly 68 through the vacuum booster 88. Vacuum booster 88 is also connected to the positive pressure source 90. The vacuum booster 88 is illustrated in FIG. 2 and described below in greater detail. A conduit 78 fluid connects the speed transducer assembly 34 and the assembly 68. The valve portion of assembly 68 operates to close conduit 76 and open conduit 78 to atmospheric pressure when the engagement relay is deactivated, and to fluid connect conduits 76 and 78 when the engagement relay is activated. Thus engine intake manifold vacuum is provided to the speed transducer assembly 34 when the system is operative. The speed transducer assembly 34 generates a speed error signal by proportioning vacuum from conduit 78 and atmospheric air pressure in accordance with a desired vehicle speed and the actual vehicle speed signal received through cable 36. This signal is transmitted through conduit 80 to the power servomotor 32 and causes the servomotor to adjust the opening and closing of the throttle valve 24 in accordance with varying road load conditions. A conduit 82 is connected with conduit 80 and a valve 84. This valve is normally in the closed position when the brake pedal 48 is in the released position, so that the end of conduit 82 is closed. However, when the brake pedal is depressed, the valve 84 opens to atmospheric pressure, immediately allowing this pressure to enter the servomotor 32 and therefore deactivate the servomotor. Since the brake switch 46 is also opened by depression of the brake pedal, the engagement relay and valve assembly 68 will also be de-energized so that the valve portion of that assembly will close the end of conduit 76 connected to engagement and relay valve assembly 68 and receiving vacuum through vacuum booster 88. The speed transducer 34 is schematically illustrated as having a mechanical connection 86 with the engagement relay and valve assembly 68. This connection is provided to drive a minimum speed switch electrically connected with electrical lead 66 and which is open until a certain minimum vehicle speed is attained. This speed may, for example, be set at 25 m.p.h. By employing this switch, the engagement relay may not be energized at lower speeds even though the switch 54 is operated in an attempt to activate the system.

The vacuum pressure selection and generation assembly 88 is referred to as a vacuum booster since it selects the greater of two vacuum pressures, one of which it can generate, and provides one of those vacuum pressures so as to effectively boost the amount of vacuum pressure available to the cruise control system under certain conditions of operation. The vacuum booster 88 has a housing 92 made of one or more pieces to provide a positive pressure inlet port 94, a manifold vacuum port 96, and a port 98 illustrated in FIG. 1 as being connected to the cruise control system through a conduit 100. The housing 92 has an opening in which is fitted a flexible wall 102 having formed therewith a valve section 104 defining a portion of a shut-off valve assembly 106. A retainer 108 is suitably fastened to the housing to hold the rim of the flexible wall 102 in sealing engagement and retention relative to the housing.

Housing 92 has inner walls 110, 112, 114 and 116 which divide the housing into several chambers. A chamber 118 into which port 94 operatively opens is divided by wall 110 from another chamber 120. Port 98 opens into chamber 120. A chamber 122 is separated by wall 112 from chamber 120 and also by wall 116 from chamber 118. Wall 116 is a tubular wall extending from chamber 118 into chamber 122. Another chamber 124 is separated by wall 114 from chamber 122. Port 96 opens into chamber 124. The inner side of flexible wall 102 defines one wall of chamber 122 and the outer side of flexible wall 102 is continually exposed to atmospheric air pressure.

A venturi 126 is placed in chamber 118 so that positive pressure from port 94 is directed through the venturi into the venturi throat 128 located in an axially spaced area between the venturi body 130 and the throat outlet port 132. Body 132 extends from chamber 118 through wall 116 so that its passage 134 opens into chamber 122. The end of body 132 located in chamber 122 defines a valve seat 136. The venturi body 130 and throat outlet body 132 are axially spaced to provide an opening 144 through which air is aspirated from chamber 118 when air under positive pressure flows through the venturi 126 into passage 134.

Wall 110 has an umbrella-type check valve 146 secured thereto and covering wall passages 148 extending through the wall and connecting chambers 118 and 120. Check valve 146 operates to permit air flow from chamber 120 into chamber 118 when there is relatively less pressure in chamber 118 than in chamber 120. Valve 146 will close passages 148 to prevent such flow when the relatively higher pressure is in chamber 118. Wall 112 has a similar check valve 150 and passages 152. These passages connect chambers 120 and 122. Check valve 150 permits flow from chamber 120 to chamber 122 but prevents reverse flow. Wall 114 has a similar check valve 154 and passages 156. Valve 154 permits air flow from chamber 122 into chamber 124 through passages 156, while preventing reverse flow.

When the vehicle engine is not operating there is no subatmospheric pressure in any of the chambers of assembly 88, and spring 140 holds the valve assembly 106 in the open position illustrated in FIG. 2. When the vehicle engine is started, aspirator shut-off by valve assembly 106 is ensured since there will be a sufficient amount of engine manifold vacuum received through port 96 and valve 154 to evacuate chamber 122 and close off valve seat 136 by the engagement of valve face 138 as the flexible wall 102 moves against the force of spring 140. Therefore there will be no atmospheric air bleed through passage 134 into the engine intake manifold vacuum system while valve assembly 106 is closed. So long as the manifold vacuum is sufficient to act on flexible wall 102 and keep valve assembly 106 closed, no aspirated vacuum is generated in chamber 118 since passage 134 is closed. Positive pressure introduced by pressure source 90 through port 94 will simply pass through venturi 126 into chamber 118 and assure the closing of check valve 146. Since there will be no flow through the venturi throat 128 into passage 134, no aspiration will take place. Manifold vacuum will open valve 154 and valve 150 so that manifold vacuum is present in chambers 122 and 120. Therefore manifold vacuum will be present through port 98 and conduit 100 to the cruise control system. The cruise control system may be energized at a suitable road vehicle speed so that vacuum under control of the speed transducer 34 is provided to the servomotor 32 to operate the throttle valve 24 as is well known in the art.

If at any time the manifold vacuum provided by the vehicle engine is insufficient to provide the necessary vacuum pressure for operation of the cruise control system, spring 140 will overcome the differential pressure acting across flexible wall 102, moving valve 104 and opening valve face 138 relative to valve seat 136. This immediately permits the flow of air under positive pressure through venturi 126 and venturi throat 128 to passage 134, aspirating air from chamber 118 and generating an aspirated vacuum pressure in that chamber. This vacuum pressure will be sufficient to operate the cruise control system and will also cause a differential pressure acting across check valve 146 to open that valve and connect chamber 118 with chamber 120. Thus aspirated vacuum pressure will be delivered through passages 148 and chamber 120 to port 98 and to the cruise control system. Since the aspirated vacuum is a greater vacuum than the manifold vacuum, chamber 120 will have a lower absolute pressure than chamber 122 and check valve 150 will be closed. Therefore the cruise control system will operate using aspirated vacuum instead of engine intake manifold vacuum. The air from passage 134 entering chamber 122 will open check valve 154 so that the air can flow into chamber 124 and port 96.

When the manifold vacuum produced by the engine intake manifold then becomes sufficient, it will generate sufficient vacuum in chamber 122 to again close valve face 138 against valve seat 136, cutting off the aspirator action and immediately causing a build-up of absolute pressure in chamber 118. This will close check valve 146. The higher manifold vacuum in chamber 122 will then open check valve 150 and the cruise control system will continue to function using manifold vacuum.

The device embodying the invention will continue to select either manifold vacuum or aspirator vacuum as required and will generate aspirator vacuum when needed.

The embodiments of the invention in which an exclusive property or privilege is claimed are defined as follows:

1. A venturi aspirator assembly for selectively generating a vacuum air pressure by use of positive air pressure to provide a sufficient vacuum air pressure output when insufficient vacuum air pressure to provide a sufficient vacuum air pressure output is generated by another source such as an engine intake manifold, said assembly comprising:

a venturi aspirator;

aspirator control valve means sensitive to vacuum air pressure generated by the other source and acting to condition said venturi aspirator to generate vacuum air pressure by positive air pressure flow therethrough only when the sensed vacuum air pressure generated by the other source is insufficient;

and check valve means sensitive to the sufficient vacuum air pressure output and the vacuum air pressure from the other source and the vacuum and positive air pressures from said aspirator and acting in response thereto to select the higher generated vacuum air pressure from which the sufficient vacuum air pressure output is then provided.

2. In an aspirator vacuum pressure generating assembly having a housing provided with a first vacuum port connected to a source of variable vacuum pressure, a second vacuum port connected to a device requiring a predetermined minimum level of vacuum pressure, and an inlet port connected to receive positive air pressure, the improvement comprising:

a venturi aspirator connected to receive positive air pressure through said inlet port and to operatively and selectively discharge air through said first vacuum port and to selectively generate vacuum pressure in said second vacuum port at at least said predetermined minimum level of vacuum pressure;

valve means operatively responsive to the vacuum pressure in said first vacuum port to selectively permit the flow of positive air pressure through said venturi aspirator so that vacuum pressure is operatively generated by said aspirator in said second vacuum port only when the vacuum level in said first vacuum port is less than said predetermined minimum vacuum level;

and check valves operatively acting between and responsive to pressures in said first and second vacuum ports and also between and responsive to pressures in said second vacuum port and venturi aspirator to establish a vacuum pressure connection between said second vacuum port and only the greater of the vacuum pressures in said first vacuum port and that generated by said venturi aspirator.

3. A subatmospheric pressure selection and generation assembly comprising:

a housing defining first and second and third chambers, a first port opening into said first chamber and adapted to be connected to a device utilizing subatmospheric air pressure when operating;

a second port opening into said second chamber and adapted to be connected to a source of varying subatmospheric air pressure;

a third port adapted to be connected to a source of superatmospheric air pressure, said third port having a venturi therein, said venturi being in said third chamber and having an opening connecting the throat of said venturi with said third chamber so that the flow of air at superatmospheric pressure through said third port aspirates air from said third chamber through said opening to generate a subatmospheric air pressure in said third chamber, said third port including a passage extending beyond said venturi and opening into said second chamber through a valve seat;

first passage means communicating said first and second chambers and having first check valve means opening to permit air flow only from said first chamber to said second chamber through said first passage means;

second passage means communicating said second chamber and said second port and having second check valve means opening to permit air flow only from said second chamber to said second port through said second passage means;

third passage means communicating said first chamber and said third chamber and having third check valve means opening to permit air flow only from said first chamber to said third chamber;

and shut-off valve means including a flexible wall forming one wall of said second chamber, a valve mounted on said flexible wall and positioned to open and close said third port at said valve seat upon movement of said flexible wall, and spring means operatively acting on said valve to continually urge said valve away from said valve seat, said flexible wall having one side exposed to atmospheric pressure and the other side exposed to pressure in said second chamber;

the subatmospheric air pressure in said second chamber acting on said flexible wall to keep said third port closed at said valve seat when the valve of the subatmospheric air pressure in said first and second ports and chambers is sufficient for operating the device, said third check valve means being closed and said first and second check valve means being open to supply subatmospheric air pressure from said second port to said first port through said second and first chambers and said second and first passage means;

said spring means acting on said flexible wall and valve to open said third port at said valve seat when the value of the subatmospheric air pressure in said second port and chamber is insufficient for the device, said subatmospheric air pressure flowing through said venturi to induce a sufficient subatmospheric air pressure for the device in said third chamber, the differential air pressure acting to open said third check valve means and close said first check valve means so that the device will receive the subatmospheric air pressure of said third chamber and not the insufficient subatmospheric air pressure of said second chamber.

* * * * *

UNITED STATES PATENT AND TRADEMARK OFFICE

CERTIFICATE OF CORRECTION

PATENT NO. : 4,380,418

DATED : April 19, 1983

INVENTOR(S) : Daniel A. Crawford
Wayne A. Levijoki

It is certified that error appears in the above—identified patent and that said Letters Patent is hereby corrected as shown below:

Title page, in the Abstract, column 2, line 4, delete "prodcuces" and insert -- produces -- .

Column 6, line 22, delete "valve" second occurrence, and insert -- value -- .

Signed and Sealed this

*Sixteenth* Day of *August 1983*

[SEAL]

*Attest:*

GERALD J. MOSSINGHOFF

*Attesting Officer*

*Commissioner of Patents and Trademarks*